US005307247A

United States Patent [19]

Cejnek

[11] Patent Number: 5,307,247

[45] Date of Patent: Apr. 26, 1994

[54] HEADLAMP FOR MOTOR VEHICLES

[75] Inventor: Milan Cejnek, Novy Jicin, Czechoslovakia

[73] Assignee: Autopal, statni podnik, Novy Jicin, Czechoslovakia

[21] Appl. No.: 948,490

[22] Filed: Sep. 22, 1992

[51] Int. Cl.[5] ..... A60G 1/00

[52] U.S. Cl. ..... 362/61; 362/298; 362/309; 362/351

[58] Field of Search ..... 362/61, 268, 298, 308, 362/309, 351

[56] References Cited

U.S. PATENT DOCUMENTS

| | | | |
|---|---|---|---|
| 2,100,913 | 11/1937 | Olsson | 362/298 |
| 3,484,599 | 12/1969 | Little | 362/268 |
| 4,800,467 | 1/1989 | Lindae et al. | 362/309 |
| 4,862,329 | 8/1989 | Nino | 362/351 |
| 4,879,636 | 11/1989 | Yamagishi et al. | 362/61 |
| 4,930,051 | 5/1990 | Golz | 362/309 |
| 4,972,302 | 11/1990 | Masuyama et al. | 362/308 |
| 5,060,120 | 10/1991 | Kobayashi et al. | 362/61 |
| 5,068,768 | 11/1991 | Kobayashi | 362/61 |
| 5,130,900 | 7/1992 | Makita | 362/61 |
| 5,169,224 | 12/1992 | Segoshi et al. | 362/61 |

FOREIGN PATENT DOCUMENTS 3718642 10/1988 Fed. Rep. of Germany .

*Primary Examiner*—Richard A. Bertsch
*Assistant Examiner*—Michael I. Kocharov
*Attorney, Agent, or Firm*—Beveridge, DeGrandi, Weilacher & Young

[57] ABSTRACT

A projection type headlamp for motor vehicles is described including a screen (3) and an objective (4). A reflecting segment (5) is provided between the screen (3) and objective (4), and the reflecting segment (5) is provided at lower side of the objective (4). The reflecting segment (5) is arranged at an inclined angle ($i_5$), when viewed in a vertical section. A refractor (6) follows the objective (4). Band lenses (62) having a diameter (R) and a width (H) are provided with the refractor (6), the lenses (62) arranged in a direction toward the reflecting surface (51) of the reflecting segment (5). The reflecting surface (51) is either rotationally symmetric or planar.

10 Claims, 2 Drawing Sheets

HEADLAMP FOR MOTOR VEHICLES

FIELD OF THE INVENTION

The invention relates to a projection-type headlamp for motor vehicles, the headlamp having an increased luminous intensity of passing light beam above the light and darkness boundary as well as an improved penetration of light into fog.

BACKGROUND OF THE INVENTION

With well-known elliptic-dioptric headlamps comprising an elliptic reflector, a screen and a lens, the lens is designed for throwing the light beam from the reflector in such a way that it is almost fully directed to below the horizontal plane so that the luminous intensity above said plane is of a minimum value. This admittedly leads to a reduction of dazzling the drivers of passing cars but, onthe other hand, due to to a poor illumination, the perception of vertical traffic signs or signals is limited, since the brightness of communicative surfaces of such signs, if illuminated by such headlamps, becomes relatively low. Apart from this, such reduced luminous intensity above the light and darkness boundary does not enable the driver to sufficiently control his activity in the upper part of his operative space. This may negatively influence any travel on untreated and unlit roads, and particularly in the absence of the so-called silhouette vision created by the lights of passing cars.

SUMMARY OF THE INVENTION

It is an object of the present invention to eliminate the drawbacks of prior art as hereinabove referred to and to provide an improved headlamp comprising a concave reflector which is designed to integrate light generated by a light source. In front of the reflector there is provided a screen to define and form the upper part of the beam of passing light, or of the fog light, and an objective to image a contract of brilliance of the screen surface on the light reflector background onto the roadway. At the lower side of the objective there is provided, according to the invention, a reflecting segment whose reflecting surface faces the objective.

In a vertical section, the reflecting surface has an inclination of focal aperture radius of the objective and constitutes a rotationally symmetric, planar, or arbitrarily formed surface. Light from the reflector edge impinges onto the reflecting surface of the reflecting segment, and the objective images the surface into the upper half-space. In the event the headlamp is provided with a refractor situated behind the objective, the light beam coming from the reflecting segment is propagated into sides by means of a zone of band lenses which is provided on the refractor and which overlaps the lower objective portion. In this way it is made possible to ensure an optimum level of luminous intensity above the light and darkness boundary, both from the viewpoint of illumination and dazzling, and to improve the visibility of vertical traffic signs and roadway markings, as well as of any possible obstacles and pedestrians, and further to improve the driver's orientation when travelling on unlit roadways as well as the position and front motion control of his own vehicle.

BRIEF DESCRIPTION OF THE DRAWINGS

A preferred embodiment of the headlamp according to the present invention will hereinafter be described in the accompanying schematic drawings in which.

DESCRIPTION OF THE PREFERRED EMBODIMENT

Figure 1:
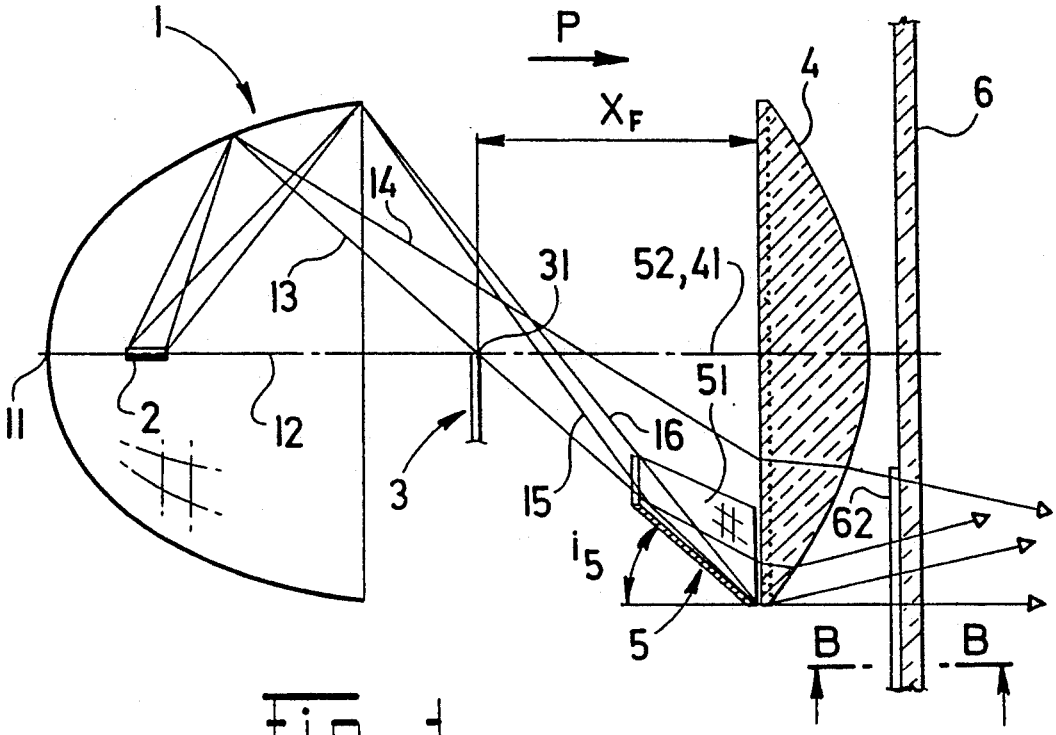
FIG. 1 is a vertical section A—A of the headlamp.

As can be seen in the drawings, and particularly FIG. 1 thereof, a light source 2 of the headlamp is situated in the axis 12 and close to the apex 11 of a concave (parabolic) reflector 1. The light source 2 is constituted by a transversely or axially oriented body of approximately cylindrical shape such as a helical bulb filament, or arc of a discharge tube. The reflector 1 is followed by a screen 3 whose section edge 31 is horizontal with fog lamp whereas broken with a passing light headlamp. Downstream of the screen 3, at the distance $X_F$ therefrom, there is provided an objective 4 of diameter D (FIG. 2) which is designed for collimating rays 13, 14 coming from the reflector 1. Upstream of the objective 4 there is provided at its lower side a reflecting segment 5 having a reflecting surface 51 close to the objective 4, the inclination angle $i_5$ thereof corresponding to the equation $$i_5 = (0.5) \cdot \text{arctg}\left(\frac{D}{x_F}\right) \tag{1}$$

wherein

D is diameter of the objective 4 and $x_F$ is the distance between the screen 3 and the objective 4.

The angle $i_5$ is either longitudinally constant, or variable in a predetermined range within its length whereby the vertical dimension of light beam to be shaped by it, can be adjusted. The reflecting surface 51 of the reflecting segment 5 is either rotationally symmetric according to the axis 52 of the segment 5, or is planar. Downstream of the objective 4 is a refractor 6 provided with band lenses 62.

Figure 2:
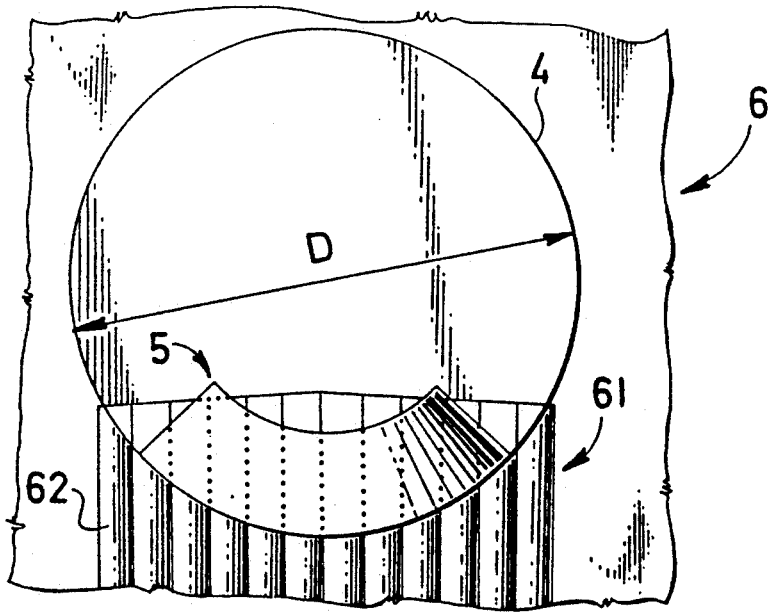
FIG. 2 is a view P of the headlamp in the direction of the light beam.

FIG. 2 shows the objective 4, the reflecting segment 5 and the refractor 6 provided with a zone 61 of band lenses 62, the zone 61 overlapping, either fully or partially, the reflecting surface 51 of the reflecting segment 5. The band lenses 62 of the refractor 6 are arranged in an about vertical position.

Figure 3:
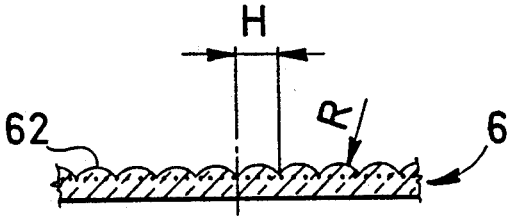
FIG. 3 is a horizontal section B—B of the headlamp refractor.

As can be seen in FIG. 3, the section B—B of the refractor 6 in the zone 61 shows the refracting profile of lenses 62 of which width H corresponds to the equation $$H=(0.14)\cdot \tag{2}$$

wherein R is diameter of the band lenses 62.

Figure 4:
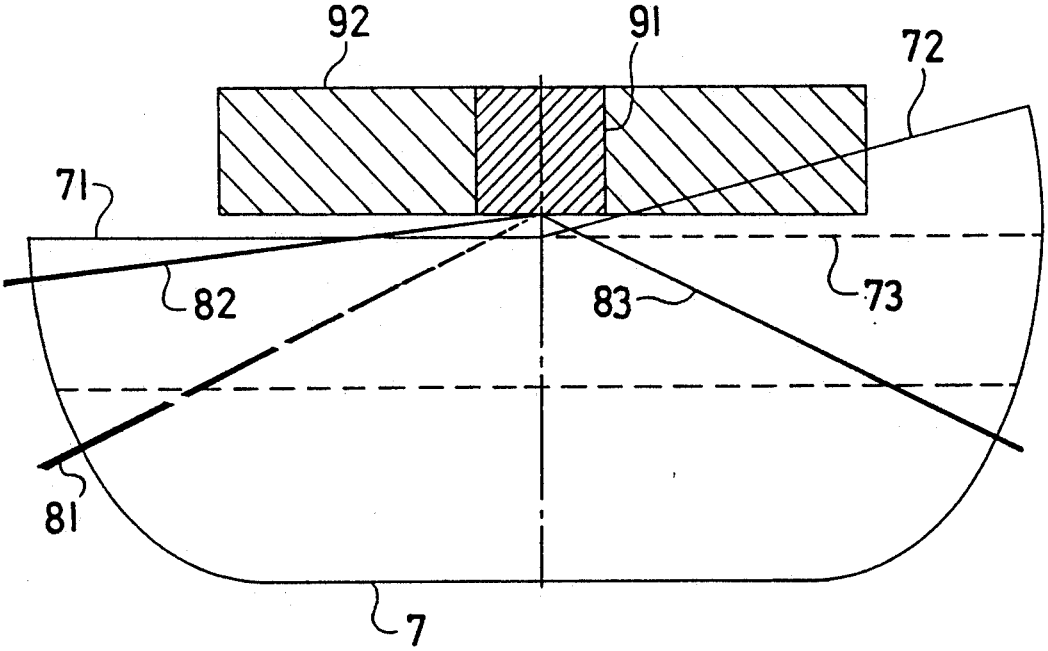
FIG. 4 is a projection of headlamp light beams into the roadway perspective.

In a roadway perspective comprising a central line 81, a lefthand verge 82 and a righthand verge 83, FIG. 4 shows a light beam 7 having a horizontal lefthand part 71 of the light and darkness boundary, and a righthand part 72 broken at said boundary with the passing light as well as a horizontal part 73 with the fog light. Rays 15, 16 coming from the edge of reflector 1 are directed by the reflecting segment 5 and by the objective 4 into the upper half-space where they form a light beam 91. The band lenses 62 of the refractor 6 expand the beam 91 into a light beam 92. By varying the side dimension of the beam 92 it is possible to adjust the luminous intensity to an optimum value from the viewpoint of both illumination and dazzling.

Industrial Utilization

The headlamp according to the invention is designed for use for any vehicles operable on land.

I claim:

1. A projection-type headlamp for motor vehicles, comprising:

a concave reflector for light integration;

a light source provided in an interior of the reflector for providing a light beam;

a screen for defining an upper part of the light beam, the screen including a screen surface;

a refractor;

an objective for imaging a contrast of brightness of the screen surface on the reflector background, a first principal plane of the objective being at an edge of the screen;

a reflecting segment having a reflecting surface provided between the screen and the objective, the reflecting segment being provided at a lower side of the objective, the reflecting surface being arranged at an inclination angle ($i_5$) with respect to a vertical section corresponding to the following equation:

$$i_5 = 0.5 \cdot arctg\,(D/x_F)$$

wherein D is a diameter of the objective, and $x_F$ is a distance between the screen surface and the objective.

2. A headlamp according to claim 1, wherein said refractor is located downstream of the objective, said refractor being provided with a zone of band lenses, said zone arranged in a direction toward the lower side of the objective, and wherein a width (H) of said band lenses corresponds to the following equation:

$$H = 0.14 \cdot R$$

wherein R is a diameter of the band lenses.

3. A headlamp according to claim 2, wherein the reflecting surface of the reflecting segment is of a rotationally symmetric shape.

4. A headlamp according to claim 2, wherein the reflecting surface of the reflecting segment is planar.

5. A headlamp according to claim 2, wherein a rotational axis of the reflecting surface of the reflecting segment is identical with an axis of the objective.

6. A headlamp according to claim 1, wherein the reflecting surface of the reflecting segment is of a rotationally symmetric shape.

7. A headlamp according to claim 6, wherein a rotational axis of the reflecting surface of the reflecting segment is identical with an axis of the objective.

8. A headlamp according to claim 1, wherein the reflecting surface of the reflecting segment is planar.

9. A headlamp according to claim 8, wherein a rotational axis of the reflecting surface of the reflecting segment is identical with an axis of the objective.

10. A headlamp according to claim 1, wherein a rotational axis of the reflecting surface of the reflecting segment is identical with an axis of the objective.

* * * * *